United States Patent [19]

Box

[11] 3,998,327

[45] Dec. 21, 1976

[54] NESTABLE PLASTIC CARRYING AND STACKING CASE

[76] Inventor: Theodor M. Box, 1108 Aileen Road, Brielle, N.J. 08730

[22] Filed: Dec. 5, 1975

[21] Appl. No.: 637,984

Related U.S. Application Data

[63] Continuation of Ser. No. 125,716, March 18, 1971, abandoned.

[52] U.S. Cl. ..... 206/508; 206/509; 206/511; 220/21; 220/23.6; 220/70

[51] Int. Cl.[2] ..... B65D 21/02; B65D 1/22

[58] Field of Search ..... 220/21, 29, 23.6, 97 R, 220/70; 206/503, 508, 509, 510, 511

[56] References Cited

UNITED STATES PATENTS

| | | | |
|---|---|---|---|
| 3,081,897 | 3/1963 | Livingston | 206/511 |
| 3,282,462 | 11/1966 | Box | 220/29 |
| 3,568,879 | 3/1971 | Box | 220/23.6 |
| 3,628,684 | 12/1971 | Sere | 220/21 |

FOREIGN PATENTS OR APPLICATIONS

| | | | |
|---|---|---|---|
| 1,404,289 | 5/1965 | France | 220/23.6 |
| 477,329 | 10/1969 | Switzerland | 220/21 |
| 1,091,344 | 11/1967 | United Kingdom | 206/511 |

*Primary Examiner*—George E. Lowrance
*Attorney, Agent, or Firm*—James H. Callahan

[57] ABSTRACT

A nestable molded plastic carrying and stacking case having corner supporting plates or slabs mounted on the base and extending inwardly from a bottom circumferential supporting edge. The plates are adapted to nest within a similar lower case when stacked thereon and have bevelled end edges adapted to facilitate lateral sliding removal of the upper case from the lower case. The case also has a top comprised of a pair of complementary hinged lid members, each having a plurality of upwardly projecting circular cups or truncated cones therein adapted to extend above the lid and provide on the upper surface additional supporting surfaces for an upper case, and on the underside stabilizing receptacles for the top portions of bottles or containers stored in the case.

5 Claims, 5 Drawing Figures

INVENTOR.
THEODOR M. BOX
BY
Kenyon & Kenyon Reilly Carr & Chapin
ATTORNEYS

INVENTOR.
THEODOR M. BOX
BY
Kenyon & Kenyon Reilly Carr & Chapin
ATTORNEYS

INVENTOR.
THEODOR BOX

BY
Kenyon & Kenyon Reilly Carr & Chapin
ATTORNEYS

NESTABLE PLASTIC CARRYING AND STACKING CASE

This is a continuation of application Ser. No. 125,716, filed Mar. 18, 1971, now abandoned.

BACKGROUND OF THE INVENTION

1. Field Of The Invention

The present invention relates to plastic nestable carrying and stacking cases, more particularly, cases for the storage and transport of beverage bottles such as milk or beer and the like.

2. State Of The Prior Art

The present invention is an improvement over application Ser. No. 41,882, filed June 1, 1970, in which a unitary stackable plastic case with a readily removable hinged cover is described. I have found that by making certain modifications to the cover and base of the case described in the copending application, the advantages of the previous case are retained while other distinct advantages are achieved as set forth below.

As can be seen by referring to the copending application, a unitary molded plastic case with a hinged upper lid or cover is described therein. This hinged cover when closed is recessed within the case, thereby allowing vertical nesting of similar cases. While incorporating all the advantages of the case described therein, I have further obtained, by bevelling a portion of the base and modifying the cover or lid, the advantage of permitting easy removal of the uppermost case in the vertical stack by reducing the frictional contact between adjacent stacked cases at their respective tops and bottoms, as well as obtained enhanced stabilization of bottles stored within the cases.

SUMMARY OF THE INVENTION

It is, therefore, an object of the present invention to provide a beverage case with sufficient rigidity and strength to permit vertical stacking, while also facilitating easy removal of the case from a vertical stack.

Another more specific object is to provide a plastic beverage case which will adequately support other similar cases in a vertical stack, provide nesting of the cases inside of each other, and further provide easy removal of a case from the vertical stack.

DESCRIPTION OF THE DRAWINGS

Other features and objects of the invention will become apparent in the following description, claims and drawings in which:

DETAILED DESCRIPTION OF THE INVENTION

Figure 1:
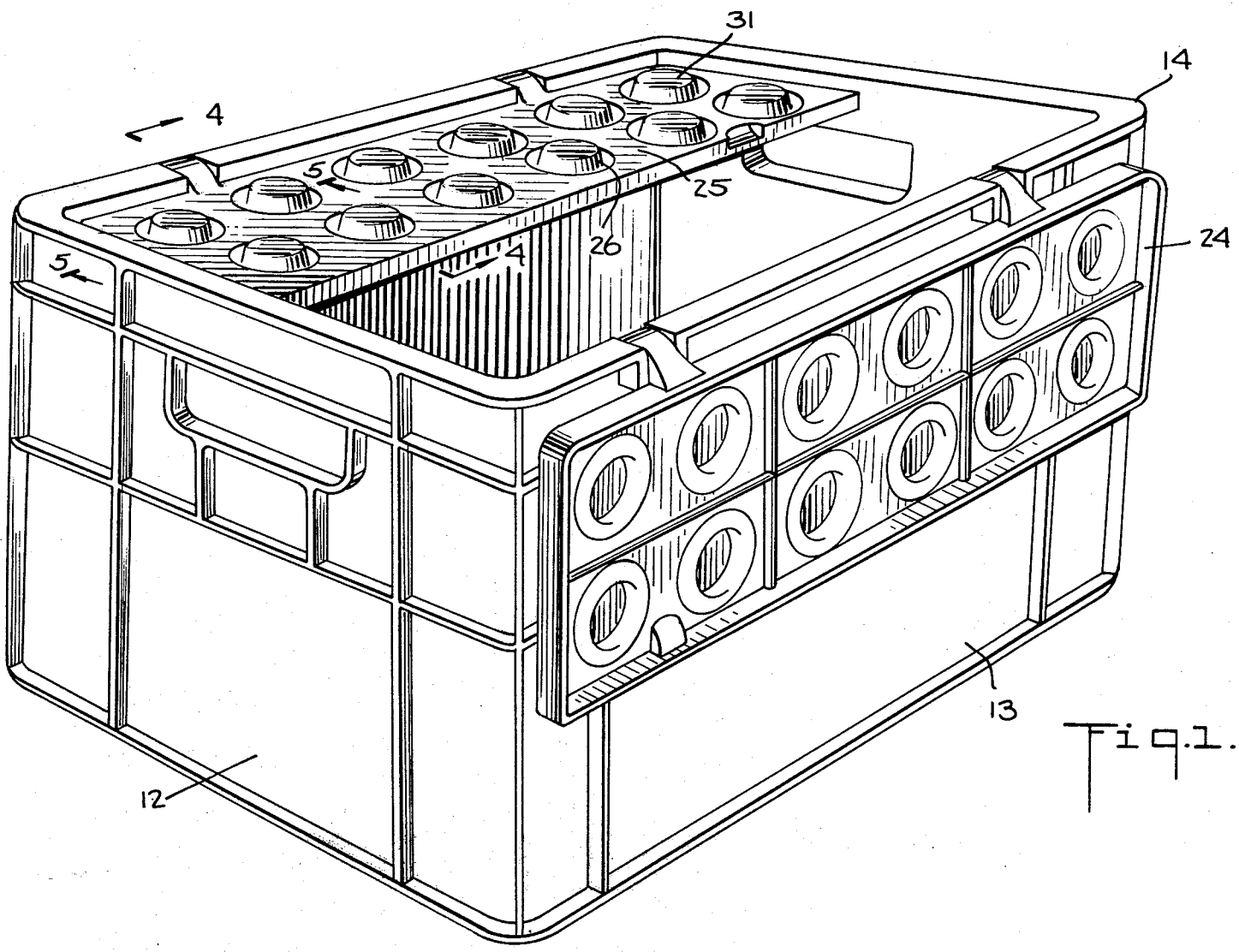
FIG. 1 is an isometric view of a plastic carrying and stacking case fitted with a hinged cover constructed according to the principles of this invention.
Figure 2:
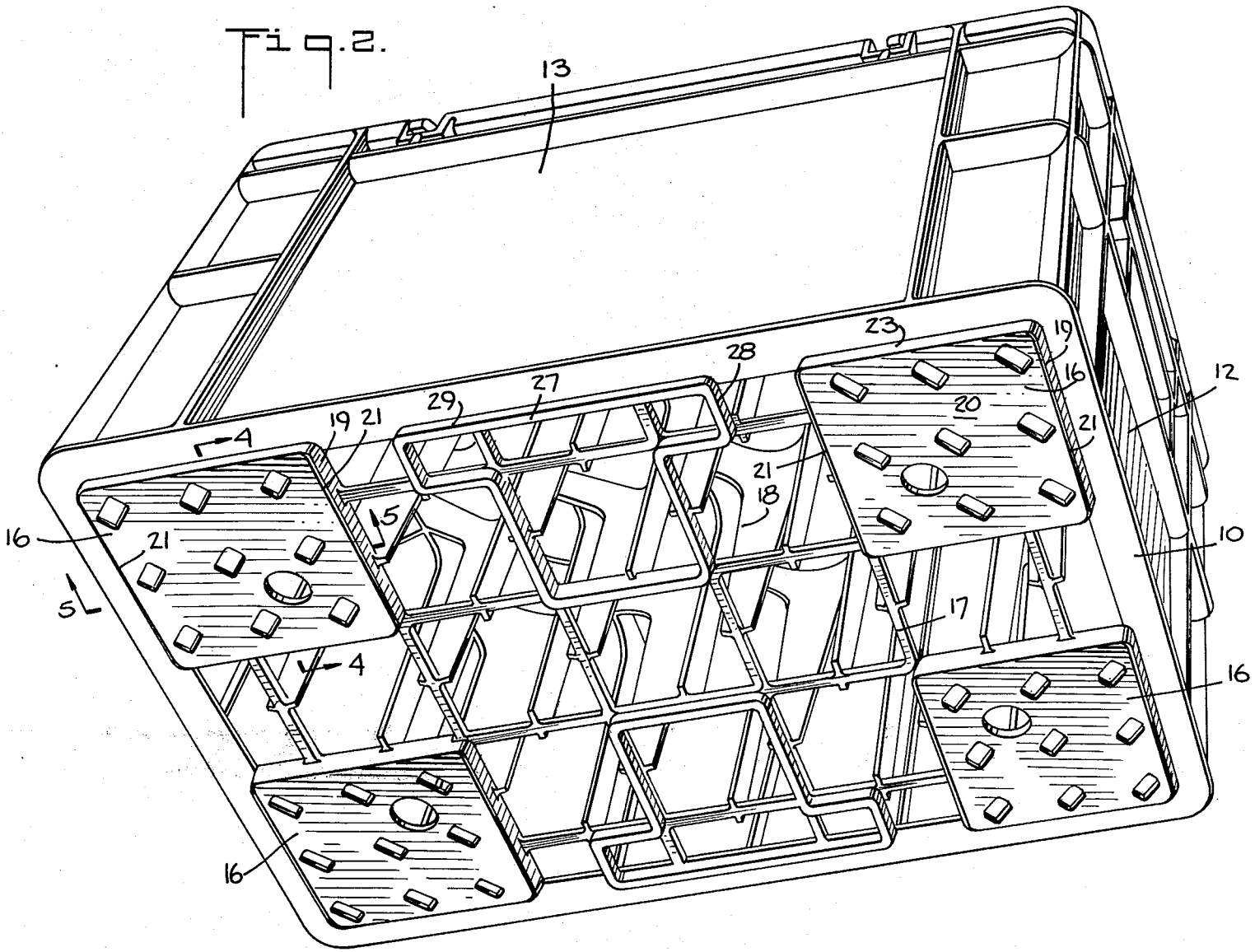
FIG. 2 is an isometric view of the bottom of a plastic carrying and stacking case constructed according to the principles of this invention.
Figure 5:
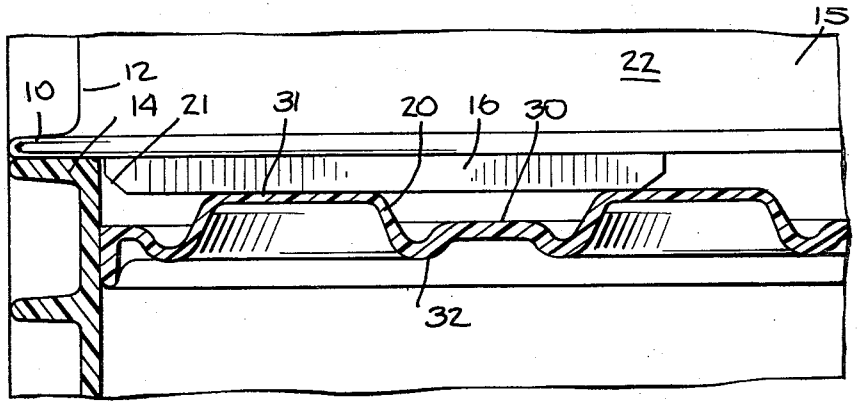
FIG. 5 is a cross-sectional view of two stacked cases taken along lines 5—5 of FIGS. 1 and 2.
Figure 4:
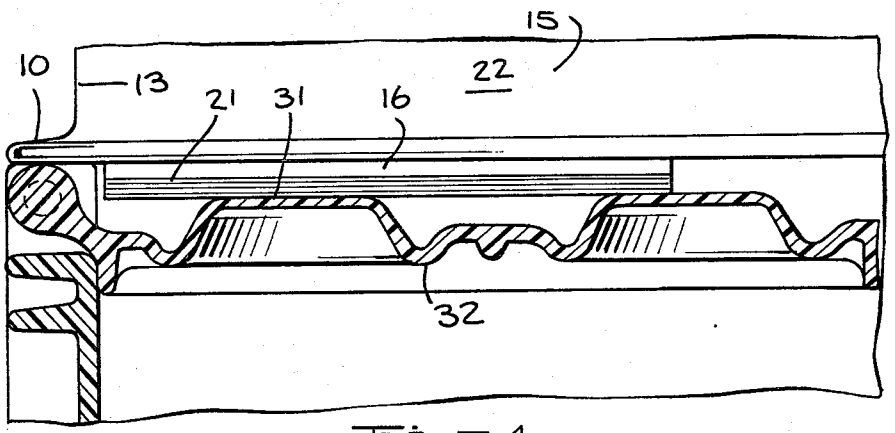
FIG. 4 is a cross-sectional view of two stacked cases taken along lines 4—4 of FIGS. 1 and 2.
Figure 3:
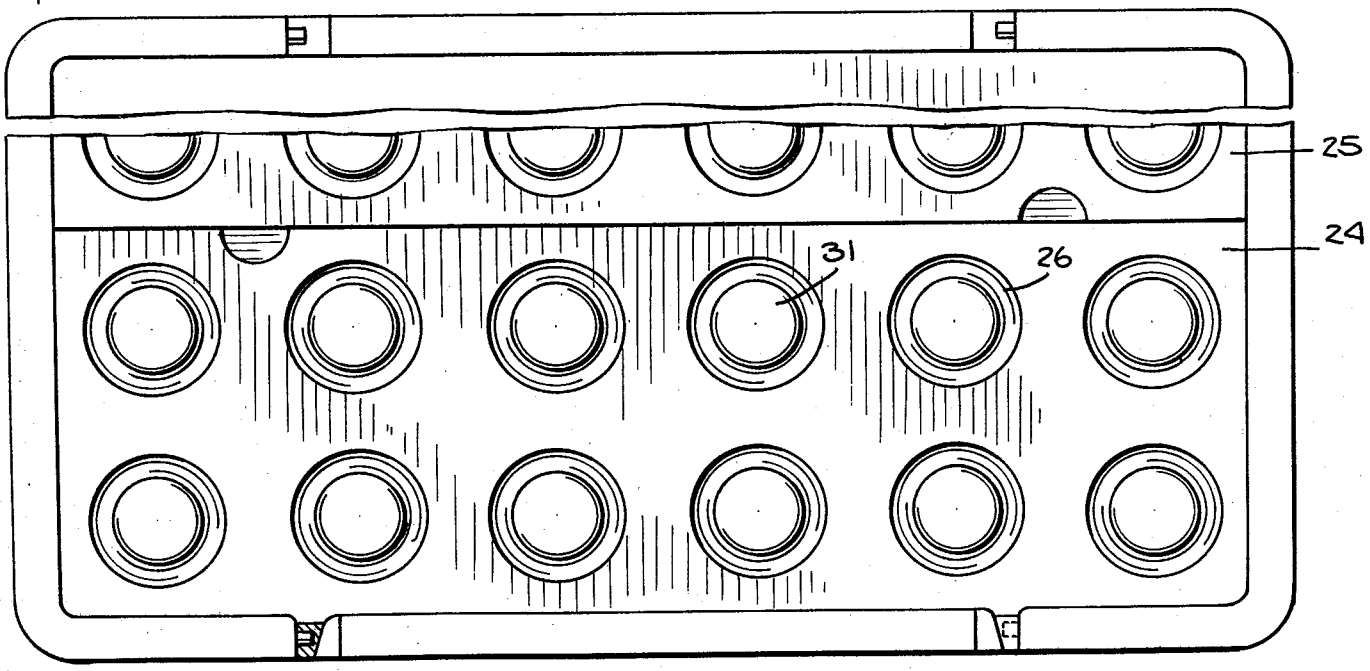
FIG. 3 is a partial plan view of the top of the plastic carrying and stacking case shown in FIG. 1.

As indicated above, the invention relates to a plastic carrying and stacking case adapted for nestable vertical stacking on other similar cases with easy removal of the uppermost case. As shown in FIG. 1, the case is integrally molded, and preferably made from high impact plastic such as polyethylene, polypropylene, PVC (polyvinyl chloride) or other suitable material. As shown in FIGS. 2, 4 and 5, the case comprises pairs of said walls and end walls, a bottom structure joined thereto and a separable cover or lid comprising a pair of hinged panels adapted to swing through 270° and lie recessed within the case to provide a supporting surface for another vertically stacked case. The panels all have a plurality of raised or upwardly projecting circular cups or flat truncated cones or bosses which serve not only to stabilize or hold the bottles in place within the case, but also provide an additional supporting surface for any case stacked on top. As also shown in FIGS. 2, 4 and 5, the bottom and top of the case have flat aligned lips or flanges which also provide supporting surfaces for any case stacked on top. In addition, the base of the case has a number of flat projecting plates or corner supporting slabs mounted to the four corners of the case with sides parallel to the interior side and end walls of the case. This combination of top and bottom lips or flanges, panelled cover with raised circular cups or truncated cones and flat projecting plates or corner supporting slabs, permits nesting of the cases on top of each other with excellent vertical and lateral support. Further, by bevelling the plate or slab edges formed between the sides of the plates or slabs and its flat upper surface, along the edges substantially parallel to the end walls of the case, I have discovered that the cases not only may be stacked with excellent vertical and lateral support, but also have the distinct advantage of easy removability. By this particular combination, the entire case does not have to be completely lifted off of the stack but may be removed by lifting one end of the case while simultaneously pulling the case from that end and thereby sliding the plates over the circular cups. During this step, because the surface area of the cups or cones is small, there is less frictional resistance to overcome and the case will slide easily. Finally, the bevelled edges allow the plates or slabs to slide over the sides of the case below, permitting quick, easy removal. This particular design provides these advantages without any sacrifice of rigidity or strength needed for such vertically stackable cases. The cases are still adequately supported by the lips, plates and cover while nesting within each other.

Referring to FIG. 2, the case 11 consists of two side walls 13, two end walls 12 and a base or bottom structure. In the preferred embodiment of this invention, integrally formed separator means are disposed within the case and supported by the side and end walls to form a plurality of bottle receiving compartments therein. The base comprises a first series of beams or rib-like projections 17 parallel to the end walls 12, and a second series of beams or rib-like projections 18 parallel to the side walls 13. As shown in FIG. 2, an enlarged bottom peripheral supporting lip or flange 10 is provided having a flat, smooth surface and disposed around the entire bottom circumference or edge of the case 11. As shown in FIGS. 4 and 5, this lip or flange 10 is perpendicular to the end walls 12 and side walls 13. The beams or ribs 17 and 18 form the base and provide the bottom support for any bottles placed within the case. They are laterally and longitudinally joined to the bottom lip as shown in FIG. 2, with their outer surface flush with lip 10 to thereby form a continuous flat plane.

The top of the case, as shown in FIG. 1, also has an enlarged top peripheral supporting lip 14 perpendicular to the end walls 12 and side walls 13. This edge 14 is similar to the bottom edge 10 and is vertically aligned therewith, as shown in FIGS. 4 and 5. Thus, when two cases are vertically stacked, these edges 10 and 14 provide excellent supporting surfaces for the upper case 15, FIGS. 4 and 5.

In addition, as shown in FIGS. 2, 4 and 5, flat corner supporting plates or slabs 16 are formed in said bottom at each of the corners of the case on top of the bottom lip 10 and ribs 17 and 18 and disposed inwardly from the lip 10. These flat plates or slabs 16 each have two sides 19, parallel to the end walls 12 of the case and a bottom surface disposed below the bottom surface of the bottom lip. When the cases are vertically stacked these flat plates or slabs, projecting outwardly from the base, rest upon the top of the truncated cones or cups 26 of the case below to provide additional vertical supporting surfaces. Further, as shown in FIGS. 4 and 5, the sides 19 of the slabs or plates 16 are parallel and aligned with the interior of the side walls 13 and end walls 12. This construction, coupled with the raised cups 26 of the recessed lid panels 24 and 25, permits the nesting of the cases within each other. Thus, the cases are properly supported by the contact between the lips 10 and 14 and the contact between the plates 16 and panels 24 and 25. By the nesting of the upper case within the lower case and the plates 16, lateral movement of the case is cut down and a firm vertical stack is maintained.

In order to insure easy removal of the cases from the stack, plates or slabs 16, extending out from the base and the lip 10, must be bevelled. As shown in FIGS. 2, 4 and 5, the sides 19 and the flat upper surface 20 form an edge 21 between the sides and top. When removing an upper case from a lower case unless the case was completely lifted off, the sides of the plates 19 would normally catch on the end walls 12. When the cases are completely filled with heavy beverage bottles, removing the case from a vertical stack in this manner can be difficult. By bevelling the edges 21 formed between the side 19, substantially parallel to the end walls, and the flat upper surface 20, as shown in FIGS. 2, 4 and 5, this problem is overcome and the cases can be easily removed by pulling on the ends of the cases and sliding the cases out over the end wall 12. The bevelling, further, need only be done to the edges 21, all of which are parallel to the end walls 12.

The description has been limited up to this point to the base, and while the case may be used without a lid, my preferred embodiment incorporates a lid or top which also contains novel features. While the lid may be a unitary one piece molding, in the preferred embodiment shown herein, the lid is composed of a pair of complementary lid members or panels 24 and 25 which are hinged from the sides 12. The features and advantages of this type of panelled cover and hinge have been described and claimed in my copending appliction Ser. No. 41,882, filed June 1, 1970, which is incorporated herein by reference. Here, as shown in FIGS. 1, 3, 4 and 5, the panels are integrally molded with a plurality of upwardly projecting circular raised cups or truncated cones 26 having a flat upper bearing surface 31 adapted to extend above the upper surface 30 of the lid. The upper surface 31 of the cones provides additional supporting surface for the slabs 16 of an upper stacked case. These cones or cups 26 are arranged in rows and columns and are adapted to provide stabilizing receptacles on their underside for the top portions of bottles or containers stored within the case. The rows are, therefore, parallel to the sides 13 of the case and the columns are parallel to the ends 12 of the case. On the lower surface of the cones a donut-shaped or lipped surface 32 is also provided to restrain the bottles from any lateral movement. By designing the case lid in this manner I obtain several distinct advantages. When bottles are placed within the case and the lid is closed the circular cups 26 in combination with the lipped surfaces 32 hold the bottles in place and prevent movement and resulting damage to the bottles. Further, when the cases are vertically stacked the cups 26, as clearly shown in FIGS. 4 and 5, provide supporting surfaces for the plates or slabs 16 nested within the lower case. Further, because the contact surface between the cases is minimized, frictional forces between the two cases is minimized and less force is required to remove a case from a stack.

The base, as shown in FIG. 2, also has two enlarged hollow T-shaped projections or ribs 27 mounted on edge 10 and ribs 17 and 18. All the sides of the projections or ribs 28 are parallel to either the ends 12 or the sides 13 of the case with the external sides of these projections 29 aligned with the sides 23 of the plates 16. Thus, when the cases are stacked, these projections provide additional lateral support for the case and prevent horizontal movement. Further, when the cases are stacked, these ribs rest upon the bearing surface 31 of the cups 26 to provide additional vertical support for the case.

By this invention, as described above, the cases are adequately supported and nest within each other to prevent tipping or lateral movement when vertically stacked. Further, by providing the case with bevelled edges on the flat projections in combination with the raised cups on the lids, not only are the advantages of nesting and vertical stacking achieved, but easy removability of the case is assured.

In the foregoing, the invention has been described in reference to specific exemplary embodiments. It will be evident, however, that variations and modifications, as well as the substitution of equivalent constructions and arrangements for those shown, may be made without departing from the broader scope and spirit of the invention as set forth in the appended claims. The specifications and drawings are accordingly to be regarded in an illustrative rather than restrictive sense.

What is claimed is:

1. A nestable plastic storage and transport case for beverage bottles and the like for stacking on other similar cases and being easily stackable on and removable from such cases comprising respective pairs of side walls and end walls and a bottom structure joined thereto, and a top having supporting means thereon, said supporting means including a plurality of upstanding bosses, integrally formed separator means disposed within said case and supported by said side and end walls to form a plurality of bottle receiving compartments therein, a top peripheral supporting lip and a bottom peripheral supporting lip having a bottom surface, said lips being formed around the top and bottom circumference of the case respectively, said lips being perpendicular to the end and side walls and providing vertical support for the upper case during the stacking of said cases, corner supporting slabs formed in, and projecting outwardly from, said bottom of the case at each corner of said case, said slabs each being disposed inwardly from said bottom supporting lip and having sides parallel to and aligned with the interior of the side and end walls and a downwardly presented support surface disposed below the bottom surface of the bottom lip and oriented parallel to said bottom surface, said supporting surface being sized to engage a plurality of said bosses for providing direct bearing contact between said slab and top supporting means of another case to provide vertical support to the stacked cases and to permit nesting of the slabs within the walls of two similar vertically stacked cases, said slabs each having bevelled bottom edges substantially parallel to said end walls to facilitate end wise removal of said case from a stack of similar cases.

2. A nestable plastic generally rectangular case for vertical stacking on another similar case, and for easy removability from said stack, said case comprising a pair of side and end walls, a base, and a top having supporting means thereon, said supporting means including a plurality of upstanding bosses, said side and end walls having vertically aligned continuous flat lips extending outwardly from the side and end walls and extending along the entire upper and lower circumferences of said walls to provide top and bottom supporting lips respectively to support adjacent cases in a vertical stack, said lower lip having a bottom surface, flat supporting slabs mounted on said base at each of the bottom corners of said case and located inwardly from said bottom supporting lip, said slabs being generally rectangular and projecting downwardly from the base and each including, two opposed side edges being generally parallel to and aligned with the interior of the side and end walls and a downwardly presented supporting surface disposed below the bottom surface of the bottom lip and oriented parallel to said bottom surface, said supporting surface being sized to engage a plurality of said bosses for providing direct bearing contact between said slab and a top supporting means of another case to provide vertical support to the stacked cases and to permit nesting of the slabs within the walls of two similar vertically stacked cases, said opposed sides having bevelled bottom edges and being adapted to facilitate easy end wise removal of a case from the top of said stack.

3. In the case according to claim 2, said slabs constituting the predominant bottom supporting surface for said case.

4. A nestable plastic case as set forth in claim 1, wherein the top comprises a pair of complementary hinged longitudinal lid members adapted in a closed position to cover substantially the entire internal cross-sectional area of the case, the bosses being hollow and having flat tops and located on each of said lids to extend above the surface of the lid to provide on the said upper surface supporting surfaces for the corner supporting slabs of an upper case and in said closed position to register with said compartments in said case to provide on the underside stabilizing receptacles for the top portions of containers stored in said case.

5. A nestable plastic case as set forth in claim 4, wherein said complementary hinged lids meet along a line substantially equidistant from the side walls of said case when in a closed horizontal position, and said bosses are arranged in rows and columns, said rows being parallel to the sides of said case and said columns being parallel to the ends of the case.

* * * * *